US007108594B2

(12) United States Patent
Swei

(10) Patent No.: US 7,108,594 B2
(45) Date of Patent: Sep. 19, 2006

(54) PERFORATED SANDING DISC

(75) Inventor: Gwo Shin Swei, East Amherst, NY (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 550 days.

(21) Appl. No.: 09/810,641

(22) Filed: Mar. 16, 2001

(65) Prior Publication Data

US 2003/0003856 A1 Jan. 2, 2003

(51) Int. Cl.
*B24B 23/00* (2006.01)
*B24B 55/10* (2006.01)

(52) U.S. Cl. ..... 451/359; 451/526; 451/456

(58) Field of Classification Search ..... 451/539, 451/526, 527, 456, 490, 494, 359, 357
See application file for complete search history.

(56) References Cited

U.S. PATENT DOCUMENTS 2,814,171 A * 11/1957 Bogart ..... 451/456
3,754,359 A 8/1973 Scandaletos
4,287,685 A * 9/1981 Marton ..... 451/359
5,309,682 A * 5/1994 Gutknecht et al. ..... 451/490
5,807,161 A * 9/1998 Manor et al. ..... 451/526
5,810,650 A 9/1998 Jost
5,989,112 A 11/1999 Long

FOREIGN PATENT DOCUMENTS

FR 2340801 * 9/1977 ..... 451/456

* cited by examiner

*Primary Examiner*—Robert A. Rose
(74) *Attorney, Agent, or Firm*—Joseph P. Sullivan

(57) ABSTRACT

Abrasive discs for use with orbital sanders having dust extractor systems are provided in which the discs have an annular perforated zone intermediate between the center and the circumference of the disc in a location corresponding to the location of dust extractor ports in the cooperating backup pad.

8 Claims, 1 Drawing Sheet

PERFORATED SANDING DISC

BACKGROUND OF THE INVENTION

Figure 1A:
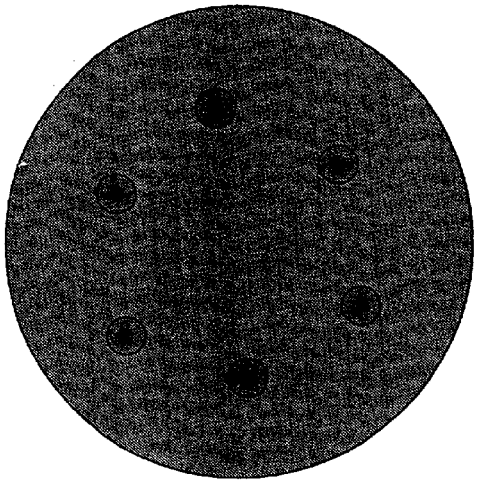

This invention relates to abrasive discs for use with orbital sanders which are designed for use with integral vacuum exhaust systems. Orbital sanders generate a great deal of dust, particularly when used on wood, polymer composites or unmodified plastics or painted surfaces. This dust is not only inconvenient and possibly injurious to health, but it also obscures the view of the surface being sanded and can "blind" the abrasive disc being used. Many manufacturers therefore sell orbital sanders with integral or readily attachable vacuum exhaust systems design to suck away the dust as it is formed. This is done by applying a vacuum to the back of the support pad to which the abrasive disc is attached and providing holes through the support pad and the disc through which the dust can be evacuated as it is generated.

However there is a problem in that the pattern of exhaust holes in the backup pads is not standardized such that abrasive discs intended for use with, for example a Black & Decker Corporation orbital sander, will not fit a sander sold by Porter-Cable Corporation. One type has five exhaust holes whereas the other has eight exhaust holes. Yet another sander, the Dynabrad, has six holes. This means that the retailer selling to the "Do It Yourself" (or DIY) market must keep at least three different stocks of abrasive discs, in all grit sizes, if he is to be able to service the needs of all his customers. This consumes valuable shelf space which becomes very inconvenient as the number of DIY products for which replacement abrasive materials must be stocked increases.

One solution to this problem is proposed in U.S. Pat. No. 5,810,650 which describes an abrasive disc with a multitude of spaced perforations all across the disc surface. The disc is backed by a porous material and swarf generated during grinding is sucked through the porous backing and ejected at the sides or, if a grinder with a vacuum extractor system is fitted, through the exhaust ports. This does however sacrifice a good deal of effective grinding surface and requires a backing with sufficient porosity to allow passage of the swarf without becoming prematurely clogged.

Another option is described in U.S. Pat. No. 5,989,112 which describes a disc for use with vacuum sanders with the five hole or eight hole pattern of exhaust ports in the backing pad. In this disc there are eight holes, as appropriate for the eight hole vacuum sander but selected holes are enlarged to coincide also with the location of the holes in a five hole orbital sander device. This works very well but the disc needs to be located on the backup pad with care to make sure the holes are in register with the holes in the backup pad. It is found however, that many workers value more highly the ability to make a disc change without even looking at the disc orientation on the backup pad. There is therefore the need for an abrasive disc for attachment to a backup pad fitted with exhaust ports that can be fitted quickly and that will not be sensitive to orientation with respect to the backup pad and will still be effective to remove swarf from the grinding surface.

DESCRIPTION OF THE INVENTION

The invention provides a circular abrasive disc having a major abrading surface provided with an annular zone, intermediate between the center and the circumference of the circular disc wherein the radial distance from the center of the disc to the annular zone is from one third to one half of the radius of the disc and the radial distance from the circumference of the disc to the zone is from one quarter to one third the radius of the disc, and, exclusively within the annular zone, a plurality of perforations, each having a diameter less than one quarter the width of the annular zone and being essentially uniformly spaced in the zone such that the distance between any pair of adjacent perforations is less than twice the greatest dimension of either perforation.

Because the annular zone is located where, (in a typical orbital sander with a vacuum device drawing air through exhaust ports), the exhaust ports are also located, the perforations are effective to cooperate with the vacuum device to remove swarf from the surface of the workpiece. Moreover there is no need to orient the disc in any specific manner because, given the distribution and size of the perforations, with conventional sanders having vacuum exhaust devices, at least two are always in register with each exhaust port and several others are in close proximity.

Preferably the annular zone has a radial width that is from a quarter to a third of the radius of the disc. Thus in a four inch (10 cm) abrasive disc, the zone is from 2.5 to about 3.3 cm in width. In such a disc the preferred perforations would be round and have diameters less than one quarter inch and preferably from about 0.05 to 0.25 inch. The perforation are "essentially uniformly" distributed within the zone and by this it is meant that the separation between perforations need not be exactly the same within the annular zone but there should be no portions of the zone that are provided with significantly fewer perforations that any other portion.

The perforations are preferably stamped out of the disc using a patterned punch providing from 4 to 40 perforations per square inch within the annular zone. The same concept can be extended to produce discs adapted to serve the needs of seven inch abrasive discs for larger orbital sanders.

The discs have first and second major surfaces. The first major surface is provided with an abrasive coating comprising abrasive particles and a binder by which the particles are adhered to the surface. The particles and binders can be selected from any of those known in the art for such applications and the configurations on the surface can be provided in any known way including patterned deposition, (as in structured abrasives), as well as the uniform deposition of the abrasive grit on a substrate bearing an uncured maker coat, followed by a size coat and optionally a supersize coat, which characterizes the more popular DIY product lines.

The second major surface is provided with a means for attaching the disc to the backup pad or an orbital sander. This means can be for example a pressure sensitive adhesive or one part of a hook and loop fastener system. Such a system is understood to include variations on this theme including those in which both surfaces to be adhered are provided with spaced, flexible mushroom or arrowhead shapes wherein the surfaces to be joined are releasably connected by pressing the shapes on one surface into the gaps between the shapes on the cooperating surface. Clearly the greater the surface area of the back of the disc, the more secure the attachment of the disc to the backup pad. This is an incentive to minimize the size of the holes as far as possible while achieving the main objective of the invention.

Alternatively but less preferably, the disc can be secured to the backup pad by any other conventional means including a lock nut cooperating with a thread on the arbor of an orbital grinder bearing the backup pad.

The perforations in the annular zone of the disc should be effective to allow passage of swarf during use but it is highly preferred that the perforated annular zone retains enough strength to resist tearing forces generated while the disc is in normal use. This consideration in effect limits the spacing of the perforations to some extent but, where the disc is attached to the backup pad at all points of the reverse, (non-abrasive-bearing), surface, in such cases the integrity of the disc is only threatened at very high grinding pressures. If however the disc is intended for use with a backup pad in which the disc is secured to the backup pad only by an arrangement such as a flanged lock nut attached directly or indirectly to the arbor of an orbital sander, the spacing will often need to be towards the limits of the range specified above.

In a preferred disc according to the invention the non-abrasive-bearing surface of the disc is provided with means to attach the disc to a backup pad. This means can be a pressure sensitive adhesive or one component of a "hook and loop" type fastener, with the complementary component attached to the surface of the backup pad. Where a hook and loop fastener device is used, the non-abrasive-bearing side of the disc can conveniently be provided with a fleece layer which acts as the "loop" component and can act to permit passage of swarf to exhaust ports in the backup pad. This allows more of the perforations to be active in swarf removal.

DRAWINGS

Figure 1B:
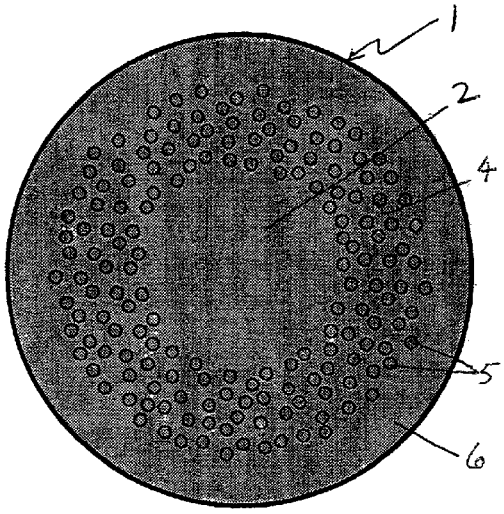

FIG. 1(*a*) illustrates a backup pad for a six-hole vacuum extractor system and FIG. 1(*b*) illustrates the surface of a disc according to the invention adapted for use with the backup pad.

Figure 2A:
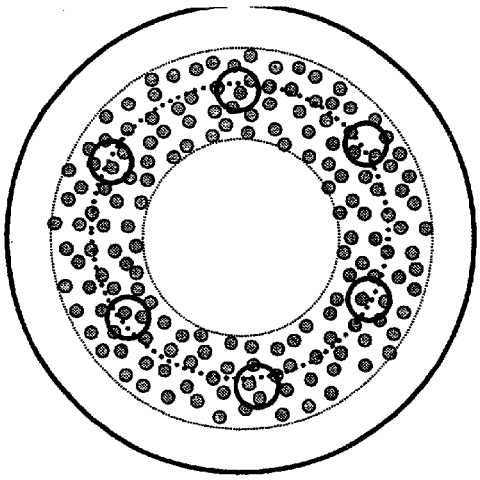
Figure 2B:
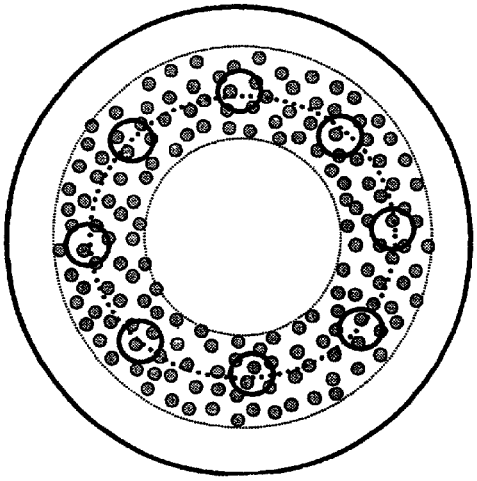

FIGS. 2(*a*) and (*b*) illustrates schematically the disc of the invention overlying a six hole backup pad, (a), and an eight hole backup pad, (b).

DESCRIPTION OF PREFERRED EMBODIMENTS

The invention is now described in the context of the Drawing appearing as FIG. 1 which illustrates the broad concept of the invention but is not considered as limiting the invention in any way.

The drawings illustrate a front view of the working surface of an abrading disc according to the invention. The surface of the disc, 1, has three distinct zones: an inner zone, 2, in which the only perforation is located axially and is the mounting aperture, 3, by which the disc is attached to a backup pad and the arbor of an orbital sander. The disc is provided with an annular zone, 4, provided with a multiplicity of perforations, 5. Radially outside the annular zone is the outer zone, 6, which is unperforated and extends to the circumference of the disc.

The surface illustrated is the abrasive-bearing surface in which case the whole unperforated area is preferably covered with abrasive particles bonded to a backing material by a cured resin bond. If the view were of the non-abrasive-bearing surface of the disc this would be covered by an adhesion mechanism for attaching the disc to a backup pad such as an adhesion-promoting means by which it can be releasably attached to a backup pad.

This abrasive disc is adaptable for use with backup pads having exhaust ports with a plurality of design hole patterns, provided that the hole patterns place the holes in the annular perforated zone that characterizes the present invention.

EXAMPLE 1

The invention is now illustrated with reference to the following Example in which the abrasive disc corresponds to disc shown in FIG. 1(*b*) with the backup pad as illustrated in FIG. 1(*a*). The disc ("Disc #1"), was compared with an identical disc that was configured in conventional fashion with five holes corresponding in location to the vacuum exhaustion holes in a Dynabrad 10,000 rpm orbital sander, ("Disc #2"). The basic disc was a commercial 12.6 cm P-400 grit alumina abrasive with a stearated surface to minimize loading with only the hole pattern varied as indicated above and a PSA backing to effect adhesion to the backup pad.

The discs were attached in turn to the sander and used to sand cast acrylic sheets. Each contact lasted ten seconds and this was repeated until a total sanding time of 12 minutes had elapsed. The load on the sander was 8 pounds and the stroke was 15.5 in at a rate of 30 strokes per minute.

The results obtained are shown in the following table.

TABLE

| | DISC #1 (Inv.) | DISC #2 (Comp.) |
|---|---|---|
| Stock Removed (gm) | 9.4 | 9.5 |
| Surface Finish ($R_z$) μ.in. | 78 | 76 |
| Anti-Loading | Very Good | Good |

The grinding performances were about equal but the anti-loading performance of Disc #1 was better than that of Disc #2 since there was less swarf in the center of the disc. Disc #1 was also significantly easier to install since there was no problem in aligning the annular zone with the vacuum exhaustion holes.

What is claimed is:

1. An abrasive disc for use with an orbital sander fitted with a dust extraction system having a plurality of exhaust ports on said orbital sander, comprising:

a circular abrasive disc having a major abrading surface provided with an annular zone, intermediate between the center and the circumference of the circular disc wherein the radial distance from the center of the disc to the annular zone is from one third to one half of the radius of the disc and the radial distance from the circumference of the disc to the zone is from one quarter to one third the radius of the disc, and, exclusively within the annular zone, a plurality of perforations, each having a diameter less than one quarter the width of the annular zone and being essentially uniformly spaced in the zone such that the distance between any pair of adjacent perforations is less than twice the greatest dimension of either perforation and at least two perforations are in register with each exhaust port on an orbital sander.

2. An abrasive disc according to claim 1 wherein the annular zone has a radial width that is from a quarter to a third of the radius of the disc.

3. An abrasive disc according to claim 2 wherein the perforations have a greatest dimension that is less than one quarter of the radial width of the annular zone.

4. An abrasive disc according to claim 1 wherein there are from 4 to 40 perforations per square inch within the annular zone.

5. An abrasive disc according to claim 1 wherein the disc has an abrasive-bearing side and a reverse side and the reverse side is provided with means to attach the disc to a backup pad.

6. An abrasive disc according to claim 5 in which the means for attaching the disc to a backup pad is selected from a hook and loop attachment pair and a pressure-sensitive adhesive.

7. An abrasive disc according to claim 5 in which a porous layer permeable to swarf generated during use is attached directly to the reverse side of the abrasive disc.

8. An orbital sander system comprising:

an orbital sander fitted with a dust extraction system having about five to eight exhaust ports on a backing pad; and a circular abrasive disc having a major abrading surface provided with an annular zone, intermediate between the center and the circumference of the circular disc wherein the radial distance from the center of the disc to the annular zone is from one third to one half of the radius of the disc and the radial distance from the circumference of the disc to the zone is from one quarter to one third the radius of the disc, and, exclusively within the annular zone, a plurality of perforations, each having a diameter less than one quarter the width of the annular zone and being essentially uniformly spaced in the zone such that the distance between any pair of adjacent perforations is less than twice the greatest dimension of either perforation and at least two perforations are in register with each exhaust port on the orbital sander.

* * * * *